United States Patent [19]

dela Cruz

[11] 4,110,853

[45] Sep. 5, 1978

[54] DISPENSING DEVICE

[76] Inventor: Luis dela Cruz, 5325 Bonita Dr., San Diego, Calif. 92114

[21] Appl. No.: 828,308

[22] Filed: Aug. 29, 1977

[51] Int. Cl.[2] ..... E03D 9/03

[52] U.S. Cl. ..... 4/227; 4/228

[58] Field of Search ..... 4/228, 227, 294, 225, 4/226, 231, 232

[56] References Cited

U.S. PATENT DOCUMENTS

| | | | |
|---|---|---|---|
| 495,563 | 4/1893 | Plumb | 4/228 |
| 2,667,646 | 2/1954 | Mouteiro | 4/228 |
| 2,839,763 | 6/1958 | Newsom | 4/227 |
| 3,787,904 | 1/1974 | Lerner | 4/227 |
| 3,952,339 | 4/1976 | Baur et al. | 4/228 |

*Primary Examiner*—Richard E. Aegerter
*Assistant Examiner*—L. Footland

[57] ABSTRACT

This invention provides a dispensing device for toilet bowl tanks. It dispenses in liquid form a normally solid purifying and disinfecting material. It may be hung directly in the toilet tank. It comprises a container having a bottom part for water entry into a chamber to dissolve the purifying and disinfecting material therein. It features a check valve arrangement for facilitating the water entry.

3 Claims, 3 Drawing Figures

DISPENSING DEVICE

BACKGROUND OF THE INVENTION

The present invention relates to dispensing devices. In one particular aspect it relates to liquid dispensing devices for toilets.

Prior art toilet bowl dispensers have usually been of the disposable type wherein a given amount of purifying material is metered out into a toilet tank and then the dispenser is disposed of. This is uneconomical in terms of the cost of repeated buying of the device and in the waste of material used to construct the device.

There is a need for a refillable toilet bowl tank dispensing device which is refillable and economical to purchase and make, and which may be refilled with material common to the average house such as soap. There is also a need for such a device which is not a safety hazard to children.

The dispensing device of this invention fulfills these needs.

SUMMARY OF THE INVENTION

Broadly, this invention provides a device for dispensing in liquid form a normally solid purifying and disinfecting material which comprises a container having a storage chamber. A mounting means is provided for detachably mounting the device within a toilet bowl tank. The container has a port in its base communicating with the chamber, and an opening in the top also communicating with the chamber. A demountable cap is provided about the top opening with a check valve in the cap.

The check valve may consist of a conduit having restricted apertures at each end, with a check ball within the conduit. The ball has a diameter less than that of the conduit but greater than that of the apertures.

The mounting means may be a substantially flat holding member parallel to and in spaced apart relationship with the back of the container. The holding member has a projection at its top which is afixed to the container. Basically the holding member may be of an inverted L structure.

The port in the base of the container may also be a substantially horizontal flat sheet having a plurality of holes through it.

The port may have depending from it a tapered conduit.

Within the storage chamber a purifying and disinfecting material in a normally solid form.

In operation, water from a flush flow enters the port in the base of the container passing up into the material storage chamber. The air in the chamber escapes through the check valve allowing water to continue entering the chamber. This proceeds until the tank is filled to its normal water level. The water in the chamber dissolves a portion of the solid material therein and when the tank is emptied as in the flushing of the toilet, the now liquid purifying and disinfecting material is released from the chamber and into the toilet. The cycle is repeated with each flush of the toilet.

DESCRIPTION OF A PREFERRED EMBODIMENT

Figure 1:
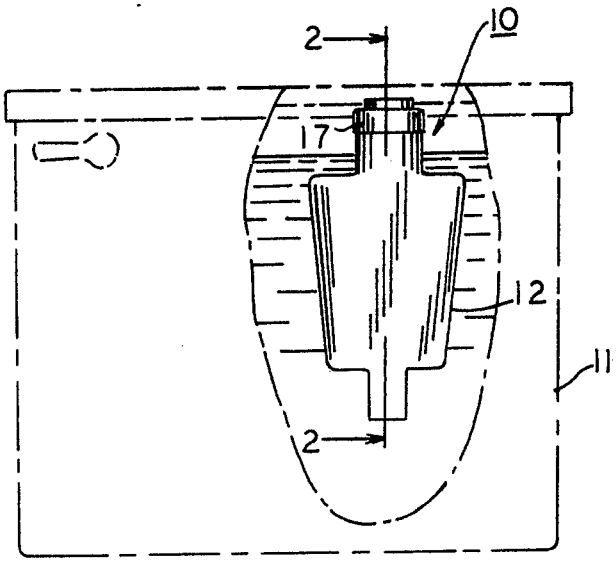
FIG. 1 is a view showing a dispensing device of this invention in a toilet tank.
Figure 2:
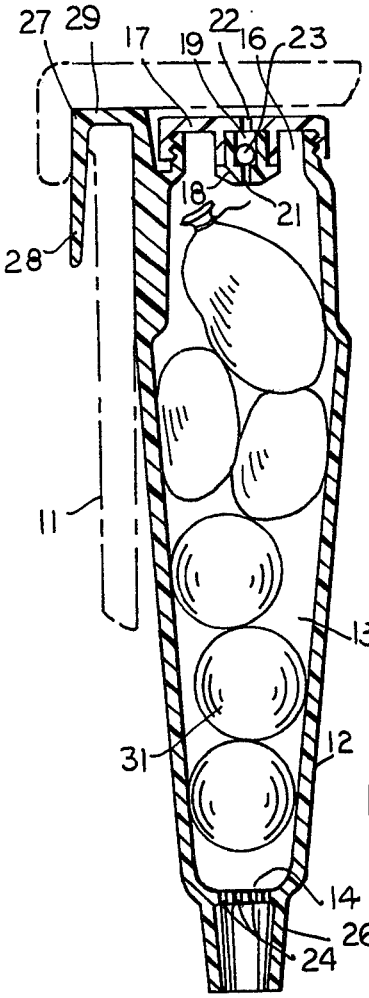
FIG. 2 is a side elevation sectional view of the dispensing device of FIG. 1.
Figure 3:
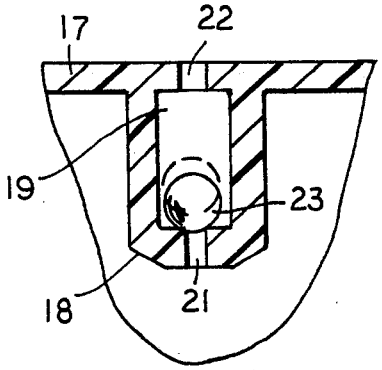
FIG. 3 is a sectional view of a check valve of the dispensing device of FIG. 1.

Referring now to FIG. 1 there is shown the device 10 of this invention in a conventional toilet tank 11. The device 10 comprises a container 12, having a storage chamber 13, a port 14 in the base of the container 12 and an opening 16 in the top of the container 12.

A demountable cap 17 is mounted about the opening 16 and is secured to the container 12 in a conventional manner e.g. by screwing it on the container 12 as illustrated. The cap 17 has a check valve 18 which as a conduit 19 which communicates with the chamber 13 by means of an aperture 21. Another aperture 22 communicates e.g. vents with the inside of the tank 11. Within the conduit 19 is a check ball 23. This ball has a diameter somewhat less than that of the conduit 19 but greater than that of apertures 21 and 22. it has been found that a $\frac{1}{8}$ inch diameter ball and apertures of 1/16 inch have proven satisfactory.

The port 14 in the base of the container 12 may be a single hole on a plurality of small holes 24 in a sheet of material covering the port. When using a plurality of holes 24 holes of $\frac{1}{8}$ inch diameter are satisfactory.

A tapered depending conduit 26 may be affixed below the opening 14.

The container 12 may be hung in a toilet tank 11 by the mounting means 27. The mounting means 27 consists of substantially flat holding member 28 which slips over the back of the tank 11. It is affixed to the container 12 by a projection 29, which projection rests on the back of the tank 11.

In operation water in the tank 11 rises up through the conduit 26 through port 14 and into the chamber 13. Air in the chamber 13 is released through the check valve 18 allowing the water to continue to rise in the chamber 13. The water in the chamber 13 partially dissolves the solid purifying and disinfecting material 31. When the tank is emptied the now liquid purifying and disinfecting material exits from the chamber 13 through the port 14 and into the toilet via the tank 11.

The main purpose of the ball check valve 18 is to delay or retard the flow or exit of the now liquid purifying and disinfecting material until to the point the water level in the tank is emptied to clear the tip of the conduit 26 thus permitting only the flow of the liquid purifying and disinfecting material at the final rinsing and sealing of the bowl.

While the materials of construction for the device of this invention are not critical satisfactory construction materials would include high density polyethylene, polypropylene, polyvinylchloride and the like. The check ball 23 may be a stainless steel ball.

When filling the chamber 13 the cap 17 is removed and the solid material 31 placed inside. This material is preferably solid chunk form, although powders in porous bags may be used. The solid material may be tinted blue so that it is clearly visible when dissolved.

What is claimed is:

1. A device for dispensing in liquid form a normally solid purifying and disinfecting material, which device comprises:

a container defining a storage chamber;

a mounting means for detachably mounting the container within a toilet bowl tank;

said container having a port in its base communicating with said chamber, said container, mounting means and port being relatively dimensioned and positioned such that said port is disposed slightly above the lowest flush water level within a toilet bowl tank when said container is mounted in its normal operating mode;

a loading opening in the top of said container communicating with said chamber and including a cap detachably mounted in said opening;

a check valve disposed in the upper portion of said container and communicating with said chamber and being disposed above the uppermost water level in said toilet bowl tank, said check valve comprising a ball located vertically above and blocking a passage that communicates the chamber with the upper ambient air of the tank and being actuated in response to a flush flow entering through said port which flow dissolves solid material in said chamber and releases a purifying and disinfecting liquid into the toilet bowl upon the emptying of the toilet tank; and wherein the port in the base of the container comprises a plurality of holes and including a depending conduit affixed to said container surrounding said port and extending downwardly to a position near the low water level in said toilet bowl tank.

2. The device according to claim 1 wherein the check valve comprises a short vertical conduit having restricted apertures at each end and a check ball within the conduit, said ball having a diameter less than that of the conduit but greater than that of said apertures such that gravity holds said ball against the lower one of said apertures absent a high relative pressure condition within said container.

3. A device according to claim 1 wherein said check valve is disposed in said detachable loading cap such that both said cap and said check valve are maintained above the high water level in said tank to avoid fouling and said check valve is easily removed with said cap for cleaning.

* * * * *